US006511339B1

(12) United States Patent
Huang

(10) Patent No.: US 6,511,339 B1
(45) Date of Patent: Jan. 28, 2003

(54) CABLE CONNECTOR ASSEMBLY WITH PUSH LOCK

(75) Inventor: Chien Shun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/010,320

(22) Filed: Nov. 9, 2001

(30) Foreign Application Priority Data

Aug. 31, 2001 (TW) ..... 90215028 U

(51) Int. Cl.[7] ..... H01R 13/627
(52) U.S. Cl. ..... 439/353; 439/578
(58) Field of Search ..... 439/578, 580, 439/579, 350–353, 270, 848, 344

(56) References Cited

U.S. PATENT DOCUMENTS 6,033,260 A * 3/2000 Murata et al. ..... 439/578
6,132,234 A * 10/2000 Waidner et al. ..... 439/358
6,267,621 B1 * 7/2001 Pitschi et al. ..... 439/584
6,296,508 B1 * 10/2001 Kuwahara et al. ..... 439/353
6,344,736 B1 * 2/2002 Kerrigan et al. ..... 324/158.1

* cited by examiner

*Primary Examiner*—Hien Vu
(74) *Attorney, Agent, or Firm*—Wei Te Chung

(57) ABSTRACT

A cable connector assembly includes a plug connector (1) and a receptacle connector (2). The plug connector includes a body (10), an insulator (12) retained in the body, a contact (13) received in the insulator, and a push lock (14) retained between the body and the insulator. An elastic portion (141) of the push lock surrounds the contact. A press button (142) extends radially outwardly from the elastic portion. When the press button is squeezed radially inwardly, the elastic portion is moved inwardly toward a center of the push lock. The plug connector is then easily inserted into the receptacle connector. When the press button is released, the elastic portion springs back outwardly. The plug connector is thereby securely and reliably engaged with the receptacle connector. When the press button is again squeezed radially inwardly, the plug connector is easily withdrawn from the receptacle connector.

5 Claims, 3 Drawing Sheets

CABLE CONNECTOR ASSEMBLY WITH PUSH LOCK

BACKGROUND OF THE INVENTION

1. Field of the Invention

The present invention relates to cable connector assemblies, and particularly to a cable connector assembly with a push lock which provides secure and reliable engagement between a plug connector and a receptacle connector of the assembly.

2. Related art

A conventional cable connector assembly is disclosed in U.S. Pat. No. 5,611,707. The assembly provides microminiature coaxial connectors which lock with each other by snap-fastening. The assembly includes two complementary connectors, and each connector includes a hollow cylindrical body. The first connector has a central pin contact received in the body, and an elastic socket between the pin contact and the body. An annular peripheral bead is formed on a free end of the elastic socket. The second connector has a skirt fitted into an open end of the body, and a central socket contact received in the body. A groove is defined by an interior surface of the skirt and by an interior wall of the body. When the first connector is engaged with the second connector, the bead is fitted into the groove. The pin contact is thereby engaged in the socket contact, providing secure connection between the two connectors. However, it is difficult and inconvenient to disconnect the two connectors. Furthermore, the connectors are liable to be damaged during disconnection.

Hence, an improved cable connector assembly having a convenient push lock is desired to overcome the above problems.

SUMMARY OF THE INVENTION

An object of the present invention is to provide a cable connector assembly wherein engagement and release of a plug connector with and from a receptacle connector is reliable and easy.

To achieve the above object, a cable connector assembly in accordance with a preferred embodiment of the present invention includes a plug connector and a receptacle connector. The plug connector includes a first body, a first insulator located in the first body, a first contact received in the first insulator, and a push lock retained between the first body and the first insulator. An elastic portion of the push lock surrounds the first contact. A press button extends radially and perpendicularly outwardly from the elastic portion. When the press button is squeezed radially inwardly, the elastic portion is moved inwardly toward a center of the push lock. The plug connector is then easily inserted into the receptacle connector. When the press button is released, the elastic portion springs back outwardly. The plug connector is thereby securely and reliably engaged with the receptacle connector. When the press button is again squeezed radially inwardly, the plug connector is easily withdrawn from the receptacle connector.

These and additional objects, features and advantages of the present invention will become apparent after reading the following detailed description of a preferred embodiment of the invention taken in conjunction with the appended drawings.

DETAILED DESCRIPTION OF THE INVENTION

Figure 1:
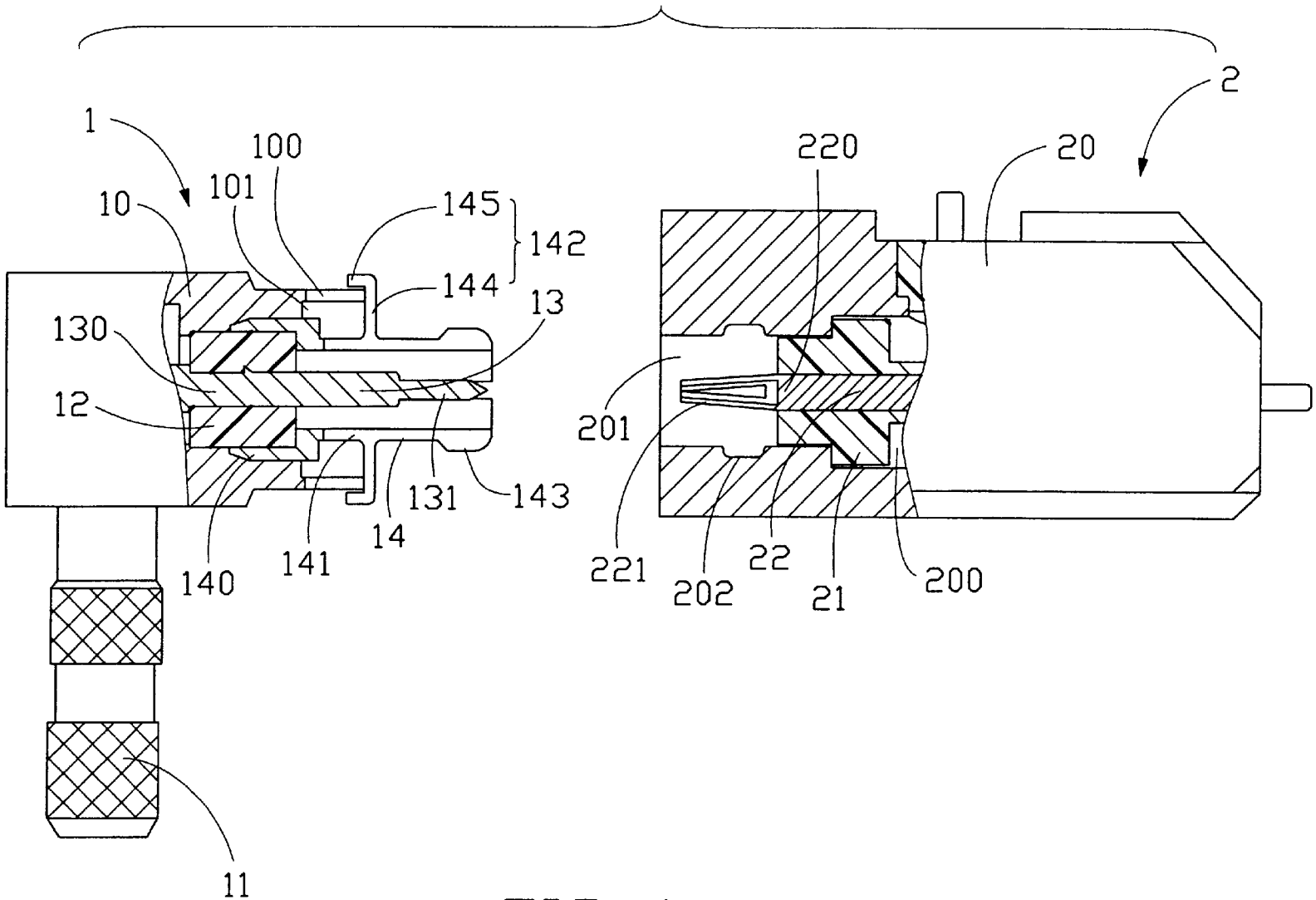
FIG. 1 is a partial cross-sectional side view of a plug connector and a receptacle connector of a cable connector assembly according to the present invention, prior to connection of the connectors.

Referring to FIG. 1, a cable connector assembly in accordance with a preferred embodiment of the present invention includes a plug connector 1 and a complementary receptacle connector 2.

The plug connector 1 includes a first hollow cylindrical body 10, a cable coupling 11 depending from a rear end of the first body 10 for coupling to a cable (not shown), a first hollow cylindrical insulator 12 retained in the first body 10, a first contact 13 retained in the first insulator 12, and a push lock 14 fitted into an open end of a front of the first body 10 and surrounding the first contact 13. The first body 10 defines a first cavity 101 in the open end thereof, and has a cylindrical wall 100 surrounding the cavity 101. The cylindrical wall 100 constitutes a skirt of the first body 10. The first contact 13 has a first position portion 130 securely retained in the first insulator 12, and a first contact portion 131 forward of the first position portion 130 and projecting beyond the open end of the first body 10. In the preferred embodiment, the first contact portion 131 is a round pin.

The push lock 14 generally surrounds the first contact 13. The push lock 14 includes a cylindrical retaining portion 140, a cylindrical elastic portion 141 extending forwardly from the retaining portion 140, a press button 142, and an annular peripheral fastener 143. The retaining portion 140 is retained between the first body 10 and the first insulator 12, to secure the push lock 14 in the first body 10. The retaining portion 140 is electrically connected with the first body 10. The cylindrical elastic portion 141, press button 142 and an annular peripheral fastener 143 are disposed in that order forwardly from the retaining portion 140. The cylindrical elastic portion 141 is disposed partly within the first body 10, and also protrudes beyond the open end of the first body 10. The press button 142 and annular peripheral fastener 143 are disposed beyond the open end of the first body 10.

Figure 3:
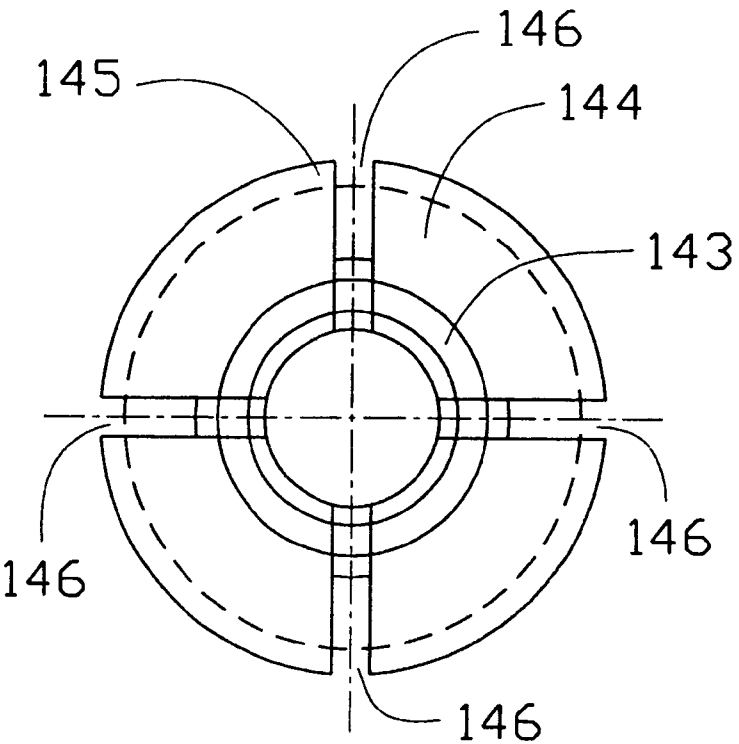
FIG. 3 is a front view of the push lock of FIG. 2.
Figure 2:
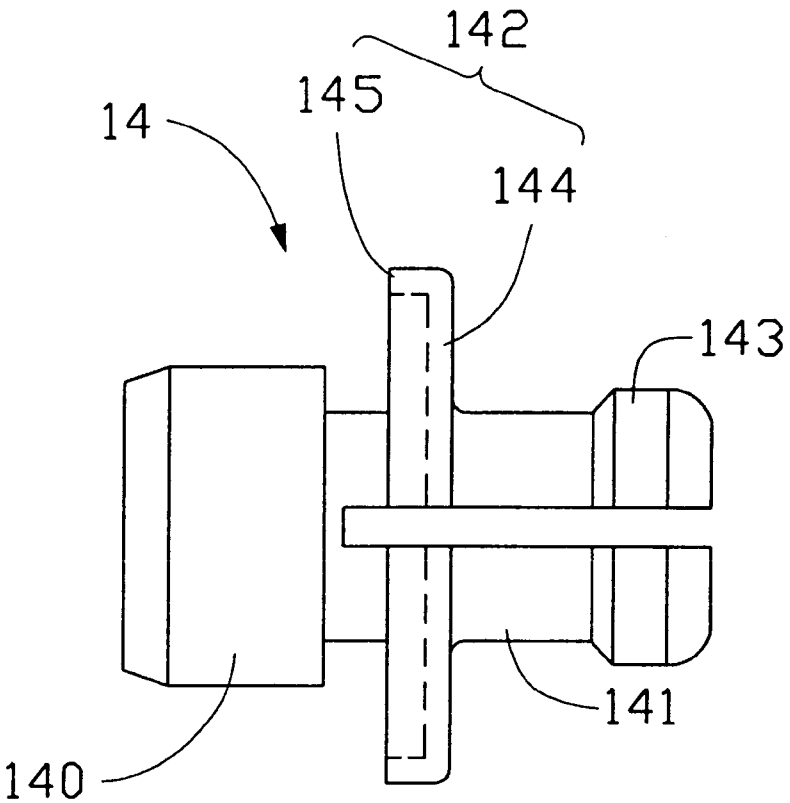
FIG. 2 is a side view of a push lock of the plug connector of FIG. 1.

Referring particularly to FIGS. 2 and 3, the press button 142 extends radially and perpendicularly outwardly from a central section of an exterior surface of the elastic portion 141. The press button 142 comprises a disk-shaped support portion 144 perpendicularly adjoining a circumferential surface of the elastic portion 141, and an annular press portion 145 extending perpendicularly rearwardly from a circumferential edge of the support portion 144. The support portion 144 contacts a front edge of the cylindrical wall 100, and the press portion 145 generally surrounds the cylindrical wall 100. The press portion 145 is spaced a small distance from the cylindrical wall 100.

The annular peripheral fastener 143 is formed at a free end of the elastic portion 141, and extends radially outwardly from an outer surface of the elastic portion 141. Four equally spaced slits 146 are longitudinally defined in the push lock 14 through the fastener 143, the elastic portion 141 and the support portion 144, to increase the resiliency of those portions of the push lock 14.

The receptacle connector 2 includes a second hollow cylindrical body 20, a second hollow cylindrical insulator 21 located in the second body 20, and a second contact 22 retained in the second insulator 21. A receiving cavity 201 is defined in a front face of the receptacle connector 2. A second cavity 200 is defined within the receptacle connector 20, rearwardly of and in communication with the receiving cavity 201. A step is thereby formed in an inner wall of the second body 20 at a frontmost extremity of the second cavity 200. The second insulator 21 has an annular step formed thereon. The second insulator 21 is located in the second cavity 200 and receiving cavity 201, with the step of the second insulator 21 abutting the step of the inner wall of the second body 20. The second contact 22 has a second position portion 220 securely retained in the second insulator 21, and a second contact portion 221 located in front of the second insulator 21. The second contact portion 221 extends from the second position portion 220 into the receiving cavity 201. In the preferred embodiment, the second contact portion 221 is a socket contact. An annular groove 202 is defined in the inner wall of the second body 20, around and in communication with the receiving cavity 201. The groove 202 is for engaging with the annular peripheral fastener 143 of the plug connector 1.

In the present invention, the first and second bodies 10, 20, the push lock 14, and the first and second contacts 13, 22 are all made of electrically conductive material such as copper. The push lock 14 is electrically connected with the first body 10.

Figure 4:
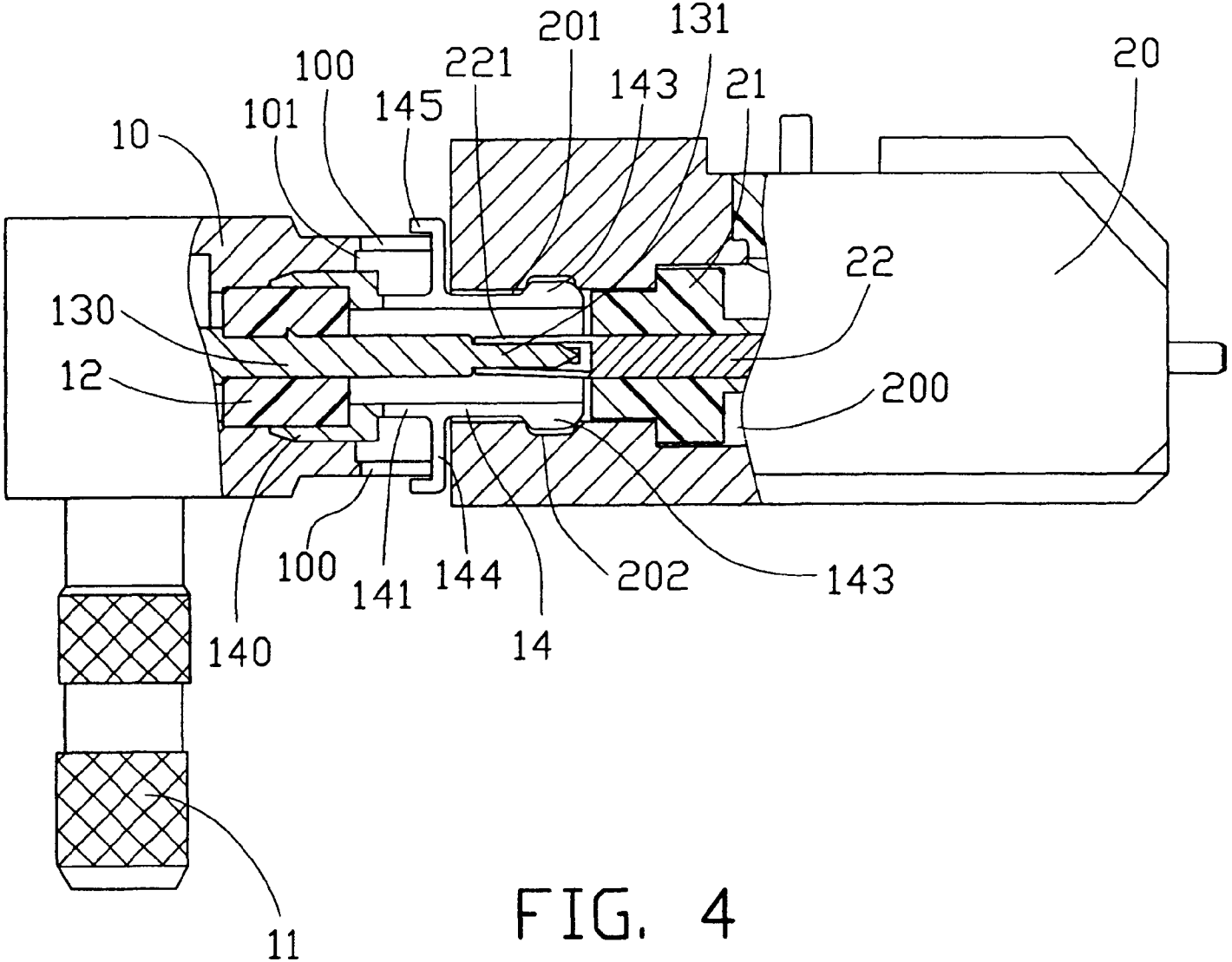
FIG. 4 is similar to FIG. 1, but showing the connectors connected together.

Referring particularly to FIG. 4, in connecting the plug and receptacle connectors 1, 2, the press portion 145 of the push lock 14 is firstly squeezed radially inwardly. This causes the elastic portion 141 to elastically deform, and the fastener 143 to contract radially inwardly. The elastic portion 141 together with the fastener 143 of the push lock 14 is then easily inserted into the receiving cavity 201 of the second body 20. The first contact portion 131 of the first contact 13 is inserted into the second contact portion 221 of the second contact 22 to electrically connect therewith. When the fastener 143 reaches the groove 202, the elastic portion 141 elastically springs back outwardly to its original form. This causes the fastener 143 to spring back out to it original position such that the fastener 143 snaps into the groove 202. The plug and receptacle connectors 1, 2, are thereby securely and reliably connected together. The fastener 143 is electrically connected with the second body 20. The press button 142 is located outside the second body 2.

To disconnect the plug and receptacle connectors 1, 2 from each other, the press portion 145 is squeezed radially inwardly. This causes the fastener 143 to escape from the groove 202. The plug connector 1 is then easily withdrawn from the receptacle connector 2.

The push lock 14 of the cable connector assembly in accordance with the present invention enables the plug and receptacle connectors 1, 2 to not only be securely and reliably connected together, but also conveniently disconnected from each other.

Although the present invention has been described with reference to a specific embodiment thereof, the description is illustrative and is not to be construed as limiting the invention. Various modifications may be made to the preferred embodiment by those skilled in the art without departing from the true spirit and scope of the invention as defined by the appended claims.

I claim:

1. A cable connector assembly, comprising:

a plug connector including a first conductive hollow body, a first hollow insulator located in the first body, a first conductive contact received in the first insulator and protruding out from the first insulator, and a conductive push lock disposed between the first body and the first insulator and electrically connected with the first body, the push lock surrounding the first contact and having an elastic portion protruding out from the first body, the elastic portion having a press button extending radially outwardly therefrom, the push lock further having a fastener formed around an end of the elastic portion, wherein when the press button is squeezed inwardly, the elastic portion and fastener are moved inwardly toward a center of the push lock, and when the press button is released, the elastic portion and fastener spring back outwardly; and a receptacle connector including a second conductive hollow body, a second hollow insulator located in the second body, and a second conductive contact received in the second insulator and protruding out from the second insulator, the second body defining a receiving cavity in front of the second insulator and a groove in an inner wall of the second body, the groove being around and in communication with the receiving cavity; wherein when the first contact is electrically connected with the second contact, the push lock is received in the receiving cavity with the fastener snapping into the groove, and the fastener is electrically connected with the second body; wherein the press button includes a disk-shaped support portion perpendicularly adjoining an exterior surface of the elastic portion; wherein the press button further includes a press portion extending perpendicularly rearwardly from a free edge of the support portion, the press portion being spaced from an exterior wall of the first body; wherein the push lock further includes at least one slit extending through the elastic portion to increase resiliency of the elastic portion.

2. The cable connector assembly as claimed in claim 1, wherein the fastener is an annular peripheral protrusion on the elastic portion, and the groove is an annular groove corresponding to the fastener.

3. The cable connector assembly as claimed in claim 1, wherein the push lock further comprises a retaining portion inserted between the first body and the first insulator, the retaining portion extending rearwardly from the elastic portion.

4. A cable plug connector, comprising:

a conductive hollow body;

an insulator received in the body;

a conductive contact having a first end secured in the insulator, and a second end extending forwardly from the first end of the contact and protruding beyond the body; and a conductive push lock having a first end secured to the body and in electrical connection therewith, and a second end extending forwardly from the first end of the push lock to a position surrounding the second end of the contact, the push lock having an elastic portion and a press button extending outwardly from the elastic portion, pressing force acting on the press button causing the elastic portion to move inwardly toward a center of the push lock; wherein the push lock further has an outward protrusion formed on the second end of the push lock; wherein the press button comprises a support portion extending perpendicularly outwardly from the elastic portion, and a press portion extending rearwardly from a free edge of the support portion and being spaced from an exterior wall of the first body; wherein the elastic portion comprises at least one slit defined therein to increase resiliency of the elastic portion.

5. The cable plug connector as claimed in claim 4, wherein at least one slit is defined through both the elastic portion and the protrusion.

* * * * *